US009041724B2

(12) United States Patent
Zeng et al.

(10) Patent No.: US 9,041,724 B2
(45) Date of Patent: May 26, 2015

(54) METHODS AND APPARATUS FOR COLOR RENDERING

(71) Applicant: QUALCOMM MEMS Technologies, Inc., San Diego, CA (US)

(72) Inventors: Huanzhao Zeng, San Diego, CA (US); Jian J. Ma, San Diego, CA (US); Tallis Y. Chang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 219 days.

(21) Appl. No.: 13/792,091

(22) Filed: Mar. 10, 2013

(65) Prior Publication Data

US 2014/0253611 A1 Sep. 11, 2014

(51) Int. Cl.

| | |
|---|---|
| ***G09G 5/02*** | (2006.01) |
| ***G09G 3/20*** | (2006.01) |
| ***G09G 3/34*** | (2006.01) |

(52) U.S. Cl.

CPC ..... *G09G 5/02* (2013.01); *G09G 3/2003* (2013.01); *G09G 3/2025* (2013.01); *G09G 3/2059* (2013.01); *G09G 3/3466* (2013.01); *G09G 2320/028* (2013.01)

(58) Field of Classification Search

CPC ..... G09G 5/02; G09G 3/2022; G09G 3/2059; G09G 3/2062; H04N 1/6008; H04N 1/6022

See application file for complete search history.

(56) References Cited

U.S. PATENT DOCUMENTS

| | | | | |
|---|---|---|---|---|
| 7,269,297 | B2 | 9/2007 | Loce et al. | |
| 7,932,953 | B2 | 4/2011 | Gutta et al. | |
| 8,295,594 | B2 | 10/2012 | Brown et al. | |
| 8,872,861 | B2 * | 10/2014 | Botzas et al. | 345/690 |
| 2011/0074808 | A1 * | 3/2011 | Huang et al. | 345/590 |
| 2011/0149166 | A1 | 6/2011 | Botzas et al. | |
| 2012/0098847 | A1 | 4/2012 | Parmar et al. | |
| 2012/0287148 | A1 | 11/2012 | Brown | |

FOREIGN PATENT DOCUMENTS

WO 2008057324 A1 5/2008

OTHER PUBLICATIONS

International Search Report and Written Opinion—PCT/US2014/021687—ISA/EPO—Jun. 10, 2014.

* cited by examiner

*Primary Examiner* — Antonio A Caschera

(74) *Attorney, Agent, or Firm* — Weaver Austin Villeneuve & Sampson, LLP

(57) ABSTRACT

Methods and apparatus for rendering colors in displays, such as adjustable interferometric modulation displays can produce many colors with different sub-sets of primary colors. Received colors to be rendered are analyzed to determine when the colors to be rendered are within a predefined neutral region of a color space. Temporal primary colors may be generated to be used for rendering the received colors in a color space that are generated by temporal modulation using at least two temporal subframes to mix first and second primary colors of a display, such as white and black primaries. The temporal primary colors are used when rendering colors that lie within the predefined neutral region of the color space. When white and black primaries are used for temporal modulation, the produced grayscale temporal primaries are more robust than using two complementary colors, affording more robust neutral and near neutral colors.

40 Claims, 10 Drawing Sheets

METHODS AND APPARATUS FOR COLOR RENDERING

BACKGROUND

1. Field

The present disclosure relates generally to color rendering to an output device, and more specifically to methods and apparatus for color rendering for output to display devices, such as binary, high-dimensional output display devices.

2. Background

In order to produce intended colors in display device, color in a source color space is transformed to a target device color space. For display devices, in order to produce intended colors that will be displayed on a target display device, normally a source color (e.g. source color space expressed as a tuple of numbers in standard RGB (sRGB)) must be converted to a color space of the target device (e.g. the device RGB of an LCD display, for example, or the device CMYK of a printer).

Since color is three-dimensional, a three-primary display can produce any colors that are within the color gamut, which is a particular subset of colors in a color space. In a multi-primary display system, such as an adjustable interferometric modulation display (AiMOD) device that employs interferometric modulation to produce particular colors using more than three primaries to produce a color, many colors can be produced with different sub-sets of primaries. For example, a gray tone may be mixed with two complementary primary colors (or three primary colors if an exact complementary primary pair is not available), or mixed with a pair of white and a black primaries. When rendering a color for display, known approaches simply find a closest primary color and use vector error diffusion to this closest primary, and these approaches may be less stable and inaccurate. Accordingly, a need exists for color rendering with greater stability and accuracy over simply finding a closest primary.

SUMMARY

According to an aspect, a method for rendering colors in a display device is disclosed. The method includes receiving a color to be rendered, and determining when the color to be rendered is within a predefined neutral region of a color space. The method further includes generating at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space.

According to another aspect, an apparatus for rendering colors in a display device is disclosed that includes means for receiving a color to be rendered. The apparatus further includes means for determining when the color to be rendered is within a predefined neutral region of a color space. In addition, the apparatus includes means for generating at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space.

According to still another aspect, an apparatus for rendering colors in a display device is disclosed. The apparatus includes a receiving unit configured to receive a color to be rendered. Additionally, the apparatus has a determining unit configured to determine when the color to be rendered is within a predefined neutral region of a color space. Finally, the apparatus includes a temporal primary generation unit configured to generate at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space.

According to yet one more aspect, a computer program product comprising a computer-readable medium is disclosed. The medium includes code for causing a computer to receive a color to be rendered, and code for causing a computer to determine when the color to be rendered is within a predefined neutral region of a color space. Additionally, the computer-readable medium includes code for causing a computer to generate at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space.

DETAILED DESCRIPTION

The presently disclosed methods and apparatus provide color rendering with greater stability and accuracy through use of determining virtual, temporal primaries along or around the area of a grayscale or neutral line or axis between the white and black primaries in a color gamut. Using virtual primaries in this area is based on the inventive recognition that a gray tone composed with a black and white primary pair may be more accurate and more stable than a tone or color composed with color primaries using simple vector error diffusion. For such a reason, the present methods and apparatus engender a color separation unified with spatiotemporal vector error diffusion for the color processing of a binary multi-primary display system, such as an AIMOD display. With the disclosed methods and apparatus, the color accuracy and color stability of gray tones under different illumination conditions are improved, and the gray balance is less sensitive to different viewing angles and more tolerant to inaccurate primary colors.

In a binary multi-primary display system, such as an AIMOD, a halftoning method may be used to process a continuous tone color for accurate color representation. Vector error diffusion may be applied to binarize a continuous tone (con-tone) color to a primary color that is closest to it, and the residue color error is dispersed to a next sub-frame for temporal error diffusion or to other neighbor pixels for spatial error diffusion.

Figure 1:
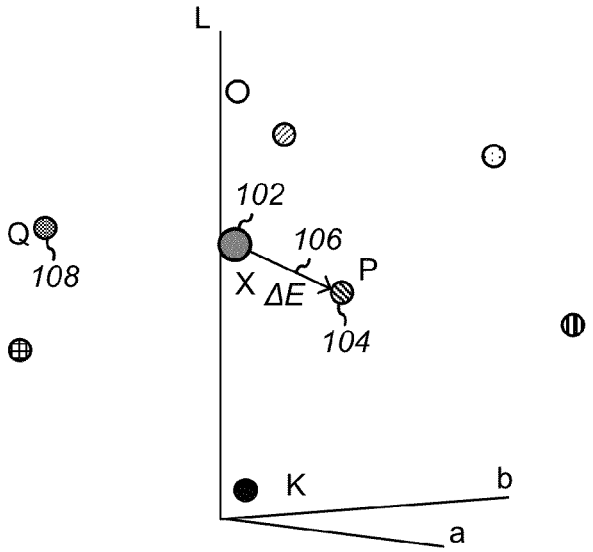
FIG. 1 illustrates color rendering of a desired input color in a 3-dimensional color space with error diffusion to a closest primary color.

FIG. 1 illustrates an exemplary color space for an 8 primary display. A particular near gray color X 102 to be rendered for display may be produced with a primary color P 104 that is closest to X. Color rendering that employs a known methodology of simply finding by mapping to a closest primary color, and then applying vector error diffusion to render the particular desired color, the error being shown as ΔE 106. As may be seen, a particular near gray color X to be rendered (shown also with reference number 102) is within the illustrated L*, a*, b* color space (e.g., CIELAB color space) 3-dimensional color space.

Figure 2:
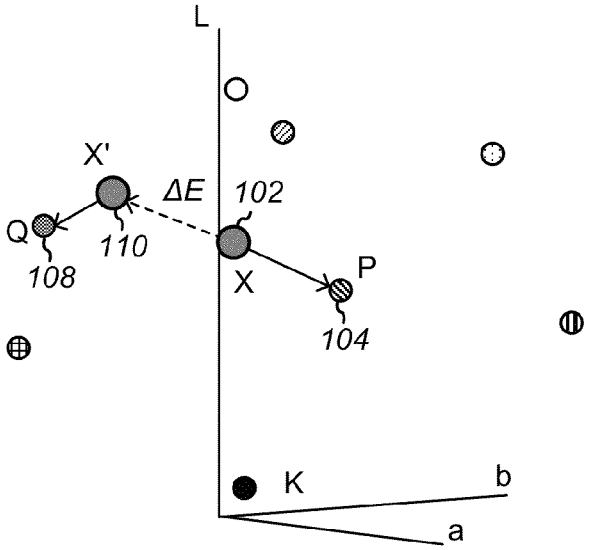
FIG. 2 illustrates color rendering of a desired input color in the examples of the 3-dimensional color space of FIG. 1 with error diffusion to a neutral color on or near a neutral line or axis according to the present disclosure.

FIG. 2 illustrates the color space of FIG. 1 in a next temporal frame. As shown, X 102 becomes X' 110 in the next temporal frame. The color is mapped to its closest primary color (i.e., Q 108) with vector error diffusion in this temporal frame. FIG. 2 illustrates that the near gray color X 102 in the color space of FIG. 1 may be produced during color rendering with two chromatic colors X 102 and Q 108, which are almost opposite in hue angle in an opponent color space. By using primaries with such properties for color rendering a near neutral color X with chromatic colors, the resultant rendering may tend to be less stable and inaccurate. That is, two near complementary saturated colors are selected to approximately represent a near neutral color. Any small drift of the primary colors will have a great impact on the color balance particularly for neutral colors. Thus, color accuracy of primary colors is very important for maintaining good neutral colors.

Figure 3:
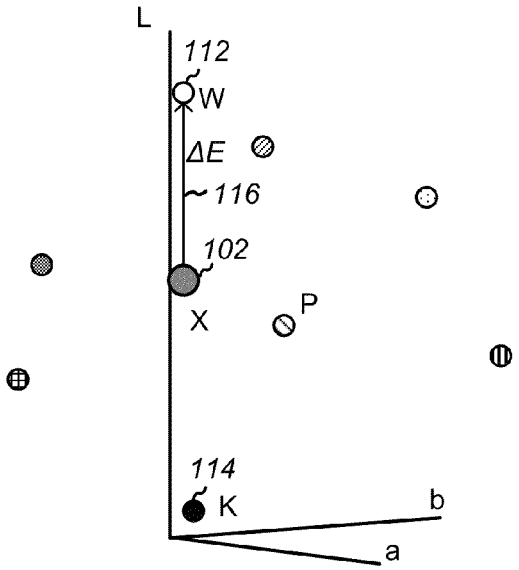
FIG. 3 illustrates mapping of a color X to the white primary with a residue error there between in a color space.

As an alternative to the rendering in FIGS. 1 and 2, FIGS. 3 and 4 illustrate the same color space where X 102 may instead be produced using the white primary W 112, and the black primary K 114. FIG. 3, in particular, illustrates that color X 102 may be mapped to the white primary W 112, with a residue error there between being shown as ΔE 116.

Figure 4:
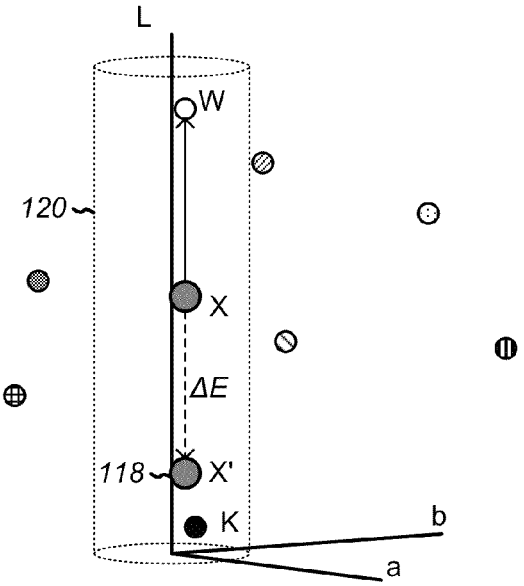
FIG. 4 illustrates mapping in a next temporal frame in the example of FIG. 3 where the color X is moved to X' after adding a residue error.

As illustrated by FIG. 4, in a next temporal frame X is moved to X' 118 after adding the residue error 116. X' is then produced with the black primary K 114 in the vector error diffusion in this temporal frame. Since X' 118 is closest to K 114, it is produced with K 114 in this frame. It is further noted that because the color X 102 is close to gray (i.e., in a neutral region of the color space approximated by the bounds of cylinder 120), it may be produced with the white primary (W) and the black primary (K), and the remaining color error is passed to a next temporal frame or to neighbor pixels. In particular, different choices of gray and near-gray tones are available for the error diffusion.

The examples of FIGS. 1-4 illustrate the concept that a color may be produced in different ways with different combinations of different sets of primaries in vector error diffusion. As discussed before, in conventional vector error diffusion, typically a nearest primary color is selected for halftoning. As X 102 was closer to the primary P 104 than the primary W 112 in the conventional example of FIGS. 1-2, primary P will be the resultant color used for the vector error diffusion. In contrast, the example of FIGS. 3-4 illustrates another way of rendering neutral color X due to its location near the neutral or grayscale region on or around the line or axis between the white primary W 112 and the black primary K 114, which may provide more stable and accurate color rendering over rendering with the two chromatic colors X 102 and Q 108. Selection of a primary color in this example is active and intentional, and not necessarily the closest primary to color X to be rendered.

Figure 5:
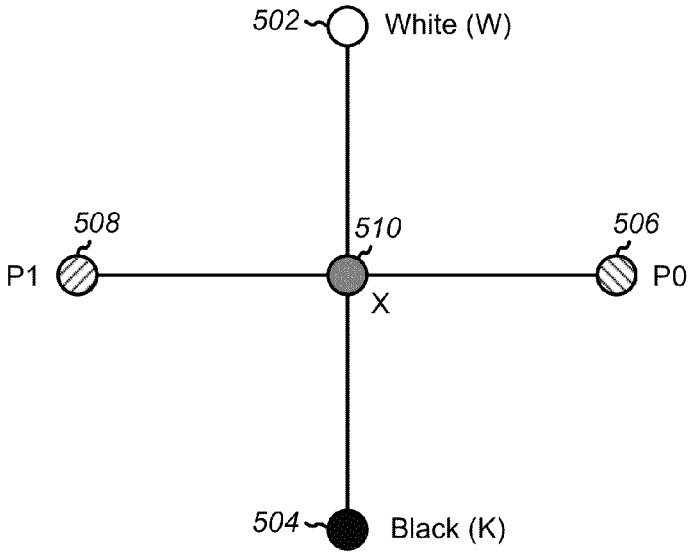
FIG. 5 illustrates an exemplary method for rendering half-tone colors by the combination of white W and black K primaries instead of chromatic primary colors.

FIG. 5 illustrates an exemplary method for rendering halftone colors by the combination of white W and black K primaries instead of chromatic primary colors P0 and P1. As illustrated, W 502 and K 504 are the white and the black primaries, respectively, and P0 506 and P1 508 are two color primaries. A neutral color X 510 may be rendered with either opposing primaries P0 506 and P1 508, or primaries W 502 and K 504. For purposes of illustration, it is assumed that primary P0 506 is closest to X 510. Rendering of X 510 will be accomplished by first displaying P0 by vector error diffusion in a first temporal frame and then displaying P1 in the next temporal frame, and the remaining color error may be passed to either a third frame or to neighbor colors. In accordance with the presently disclosed methods and apparatus, W 502 and K 504 are used to produce the color X instead. It is noted, however, that although W 520 and K 504 are used to produce color X, production of X with W and K is not done with conventional vector error diffusion that would be used when utilizing color primaries (e.g., P0 and P1) as will be explained in more detail later.

Figure 6:
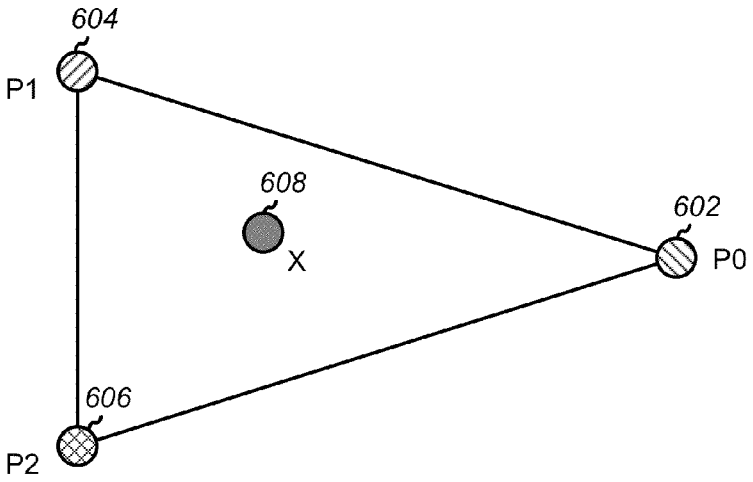
FIG. 6 illustrates an example of the use of three chromatic primaries for approximately producing a color X.
Figure 7:
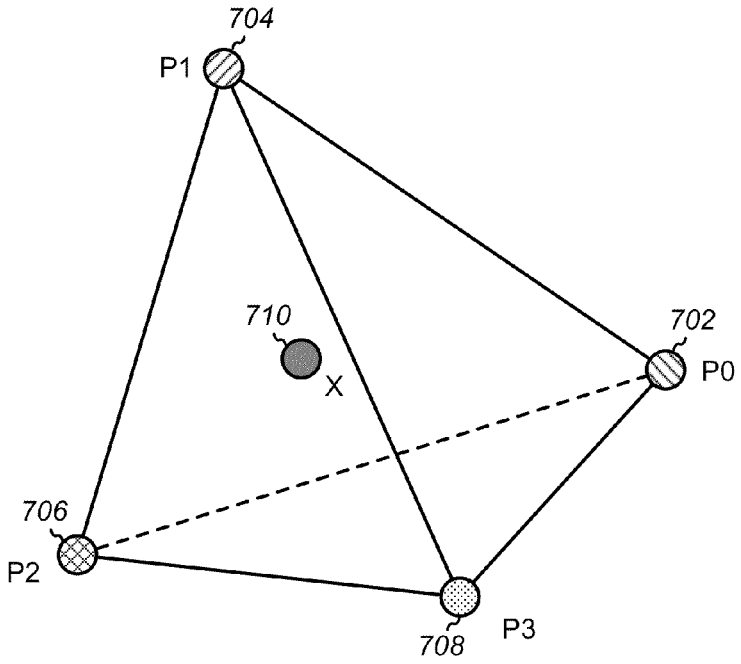
FIG. 7 illustrates an example of the use of four chromatic primaries for approximately producing a color X.

FIGS. 6 and 7 illustrate further examples representing more complex and more realistic situations for color rendering where three or more primaries are needed to render a particular color X. In the example of FIG. 6, three primaries P0 602, P1 604, and P2 606 are needed to approximately produce a color X 608. Here the production of the color X may be executed using three consecutive temporary frames (i.e., "sub-frames"), each frame applying one of the three primaries such that the resultant temporal mixing is color X.

FIG. 7 further illustrates an even more complex situation where four primaries P0 702, P1 704, P2 706, and P3 708 in a 3-dimensional color space are used over four subframes for dithering. This allows a color (e.g., color X 710) to be rendered more closely or accurately with a resultant small residue color error that may be eventually dispersed to neighbor pixels by spatial error diffusion.

Because the white W and black K primaries are at the top and the bottom ends in a color space, many high frequent midtone colors have large distances to W and K. Thus, the probability that white W or black K would be selected in vector error diffusion may be fairly low. Nonetheless, if the color X in the examples of FIGS. 6 and 7 is a near neutral color, it is noted that the color rendering may be accomplished through dithering with the white and black primaries (W and K) using a portion of or all of the temporal sub-frames. In particular, through application of temporal subframes using just the W and K primaries, different virtual primaries along or near the line or axis between the W and K primaries may be engendered through use of these temporal subframes. Because such virtual primaries are located in the middle of the color space (generally along the W-K line or axis), adding such primaries would greatly increase the probability that the W and K primaries would be selected for rendering a color X in or near this middle region of the color space.

Figure 8:
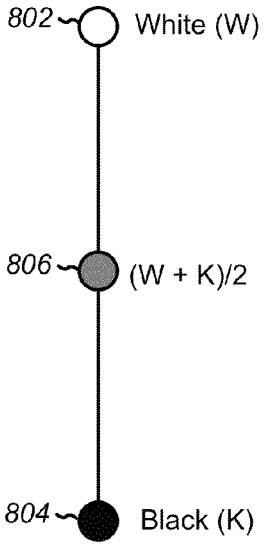
FIG. 8 illustrates production of a virtual primary produced with two subframes using white and black primaries.

FIG. 8 illustrates production of a virtual primary produced with two subframes using the white and black primaries (W and K). As illustrated, the white primary 802 and the black primary 804 are mixed such that they are combined for two subframes to produce virtual primary 806. Hence, the virtual primary is indicated by the sum of the primaries W+K divided by two (e.g., the white primary is turned on in a first subframe and the black primary is turned on in a second subframe of two total subframes, thereby "mixing" the two temporally resulting in the display of a primary color in between the two primaries as will be perceived by the human optical system). Since two frames are used to generate this virtual primary 806, this primary is only used as a candidate for the error diffusion at the first subframe, as the decision must be made timing-wise in the first subframe as the virtual primary requires two subframes to produce.

Figure 9:
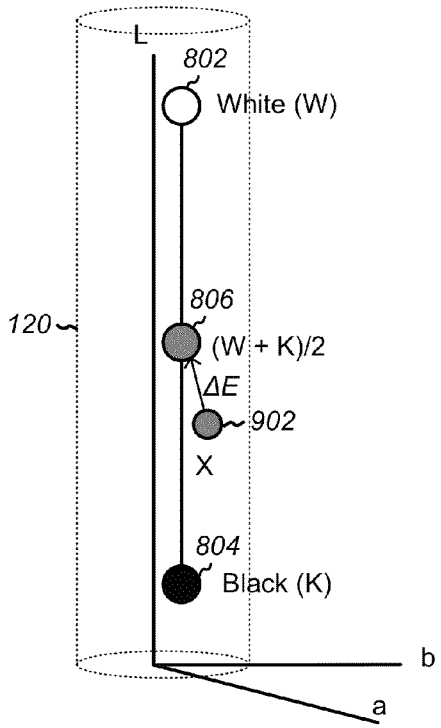
FIG. 9 illustrates part of a process of rendering a color X using a virtual primary from the example of FIG. 8 in a CIELAB color space.

FIG. 9 illustrates part of the process of rendering a color X using the virtual primary illustrated in FIG. 8 in a CIELAB color space. As illustrated, if color X 902 is a neutral color, rather than rendering using chromatic primaries (not shown) or even the W and K primaries (802, 804), if color X 906 is close to the virtual primary 806, the color X may be rendered with this primary over two temporal subframes. Additionally, the vector error diffusion is reduced as color X 902 is closer to the virtual primary over either primaries W and K or other chromatic primaries.

Figure 10:
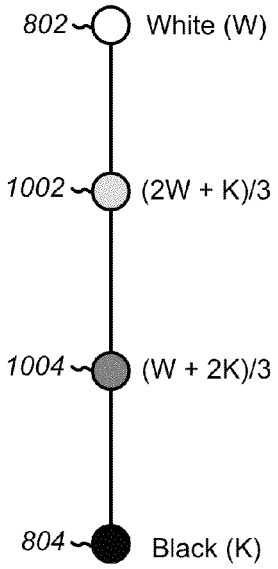
FIG. 10 illustrates another example of producing virtual primaries where three subframes are used for the temporal modulation.

FIG. 10 illustrates another aspect where three subframes are used for the temporal modulation, resulting in two more virtual primaries. As illustrated, the virtual primaries produced using three subframes are a virtual primary 1002 using two (2) frames of the white primary W (802) and one (1) frame of the black primary K (804). The other virtual primary 1004 uses two (2) frames of K and one (1) frame of W. These virtual primaries 1002, 1004 may be in addition to the virtual primary 806 produced by two subframe modulation. In other words, if a color X to be rendered would be closest to virtual primary 806, then only two subframe modulation would be needed, as this is all that is needed to produce that virtual primary. On the other hand, if a color X to be rendered would be closest to one of virtual primaries 1002 or 1004, then three subframe modulation would be utilized to produce those primaries. In both cases, the remaining subframes are used for further temporal modulation.

Further, since the two virtual primaries 1002 and 1004 are produced with 3 frames, they are candidate colors for the error diffusion at the first frame only in terms of timing if three (3) subframes are used for temporal modulation. If one of these primaries is chosen, all three subframes are used to produce this color. Additionally, it is noted that the two subframe primary, if chosen, may be applied to the temporal error diffusion at the first and second subframes, but not the last of 3 subframes, because it takes two of three subframes in this example to produce this color.

Figure 11:
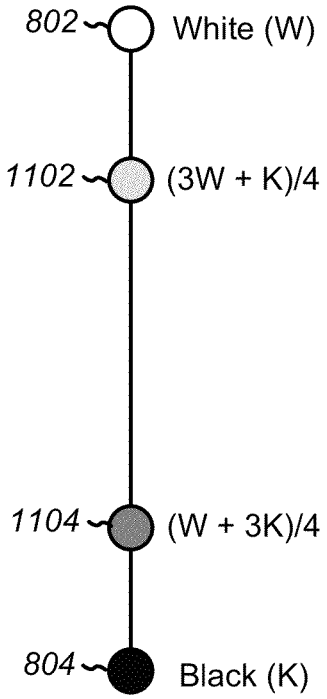
FIG. 11 illustrates yet another example of producing virtual primaries where four subframes are used for the temporal modulation.

FIG. 11 illustrates yet another aspect wherein two more virtual primaries may be produced using four (4) subframe modulation. In this example, more virtual primaries may be produced by temporal modulation of the white W 802 and black K 804 primaries as illustrated by virtual primaries 1102 and 1104. As illustrated, if four subframes are used for the temporal modulation, besides there virtual primaries mixed virtual primary 1102 is produced with three (3) frames of W 802 and one (1) frame of K 804, while the other virtual primary 1104 is produced with three (3) frames of K 804 and one (1) frame of W 802.

Since these two virtual primaries 1102 and 1104 in the example of FIG. 11 are produced with four frames, they are candidates for the error diffusion at the first frame only in terms of timing if four (4) subframes are used for temporal modulation. That is, if one of the 4 subframe virtual primaries is chosen, all four subframes will be used to produce this color and error diffusion will need to be applied starting with the first subframe. Further in this example, the three subframe virtual primaries (i.e., 1002 and 1004) would be candidates at the first and the second subframes, as at least three of the four subframes are needed to produce these colors. Still further in this example, the two subframe virtual primary is a candidate at all frames except the last frame as at least two of the four subframes are needed to produce this color primary.

Figure 12:
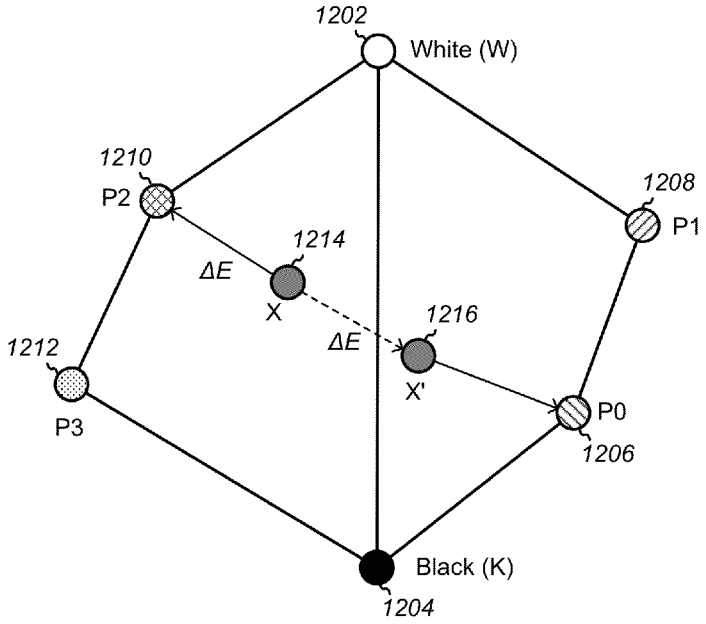
FIG. 12 illustrates a color space for a binary display having six primaries.

FIG. 12 illustrates a color space for a binary display having six primaries, as merely one example. The color space includes white (W) 1202 and black (K) 1204 primaries, as well as four color primaries P0, P1, P2, and P3, and designated by reference numbers 1206, 1208, 1210, and 1212, respectively. For purposes of this example, it is assumed that two temporal subframes are used for temporal error diffusion and that spatial error diffusion is subsequently applied. According the conventional methodology, when a neutral or near-neutral color X 1214 is to be rendered, the closest primary is selected. In the illustrated example, P2 1210 is the closest primary to the color X 1214, and thus color P2 1210 would be produced at the first sub-frame. Adding the color error to X for the next sub-frame, X is shifted to X' 1216 by the amount of color error ΔE. The color closest to X' 1216 in the illustrated example is P0 1206, and is therefore is produced with P0. The residue color error is then dispersed to neighbor pixels for spatial error diffusion in subsequently processed pixels.

Figure 13:
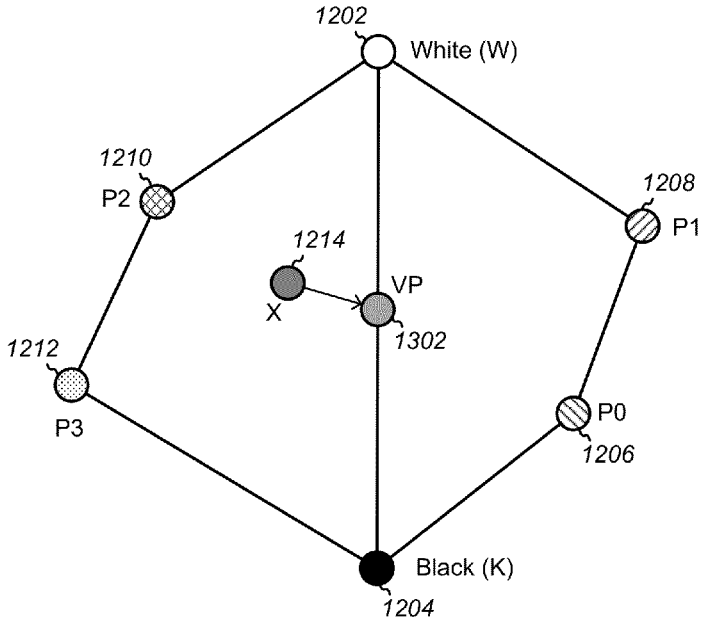
FIG. 13 illustrates the use of a virtual primary according to present disclosure in the color space of FIG. 12.

In contrast to the example of FIG. 12, FIG. 13 illustrates the use of a virtual primary according to present disclosure. In particular, FIG. 13 also illustrates a color space for a binary display having six primaries, continuing with the example used in FIG. 12. According to an aspect, a virtual primary VP 1302 is mixed by W 1202 and K 1204 from two subframes (e.g., (W+K)/2). Since VP 1302 is closest to X 1214, VP 1302 is selected to produce the color X in vector diffusion. For example, the color X may be produced with primary W 1202 in the first subframe, and primary K 1204 in the second subframe. The residue color error is then dispersed to neighbor pixels for spatial error diffusion. Compared to the conventional approach, the presently disclosed approach is more likely to yield the use W and K for rendering colors close to the neutral line or axis, which affords production of low chroma virtual primary colors for color rendering that effect better stability and accuracy.

Figure 14:
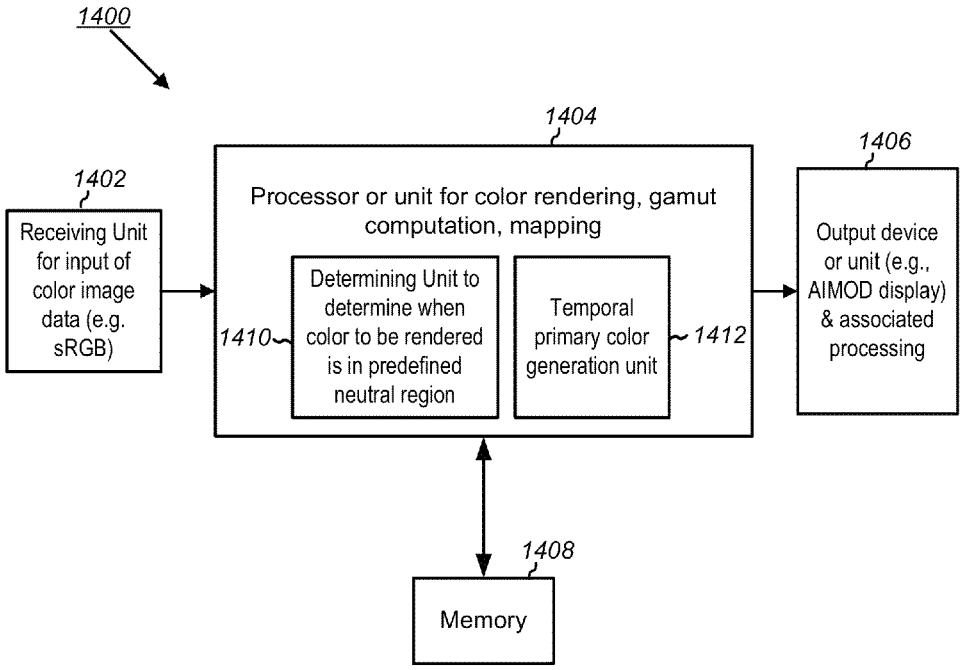
FIG. 14 illustrates an exemplary apparatus 1400 that may be used to render colors for display, such as display with an AIMOD display.

According to an aspect, the methodology discussed above may be implemented with an apparatus including a processor(s) used for controlling a display device. As an example, FIG. 14 illustrates an exemplary apparatus 1400 that may be used to render colors for display, such as display with an AIMOD display. Apparatus 1400 includes an input or receiving unit 1402 to receive or input color image data for display. A processor or processing unit 1404 uses the input color image data for color rendering. Unit 1404 may effect processing including mapping the input color space to the output device color space in a manner to best optimize faithful reproduction of the input color space in the output device. The process of color reproduction includes color transformation of the input color data to the color space of the output device color space, and may be performed by various algorithms for gamut mapping, color separation, and so forth. The color rendering information and error diffusion is then passed to a display, and any associated processing or logic as illustrated by unit 1406.

In accordance with the present disclosure, unit 1404 is configured to perform color rendering by determining and using the virtual primaries when a color to be rendered is in or close to the grayscale region (e.g., 120) such that the W and K primaries may be utilized to temporally create the virtual primaries. Furthermore, unit 1404 may be configured to determine or decide when a color to be rendered (i.e., color X) is located in or near the neutral, grayscale region between the W and K primaries such that use of virtual primaries is warranted for rendering. Instructions or code for algorithms implemented by unit 1404 may be stored in a memory device or computer readable medium 1408.

According to a further aspect, the processor or unit 1404 may include functional units 1410 and 1412, which could be either part of the processor unit 1404 as illustrated, or discrete units or logic apart from unit 1404. Unit 1410, in particular, is a determining unit configured to determine when the color to be rendered is within a predefined neutral region of a color space, such as region 120 illustrated in FIG. 4. as merely one example. Unit 1412 is a temporal primary generation unit that is configured to generate at least one temporal primary color in accordance with the methodology discussed herein. In particular, the temporal primary color that is generated is configured to be used for rendering a color in a color space, as opposed to the fixed primaries, for example. In an aspect in accordance with the methodology discussed herein, the temporal primary color is generated using temporal modulation using at least two subframes to mix at least first and second primary colors, such as those temporal primaries 806, 1002, 1004, 1102, or 1104 generated in the examples of FIGS. 8, 10, and 11. Still further, the at least one temporal primary color is operable for rendering the color to be rendered when it is determined that the color to be rendered is within the predefined neutral region of the color space, such as the region on and around the axis between the white (W) and black (K) primaries.

Unit 1404 may also be include the functionality of rendering the color, and may be configured as including a rendering unit (not shown) that serves to render the color in the color space for display using error diffusion with the at least one temporal primary color. In an aspect, unit 1404 may be configured to determine timing of when to apply error diffusion is based on a selected subframe modulation scheme of one of the two, three, and four subframe modulation schemes. The rendering unit may be further configured to apply error diffusion for a two subframe primary at a first subframe in a two subframe modulation scheme, apply error diffusion in at least a first subframe for a three subframe temporal primary in a three subframe modulation scheme, and applying error diffusion in one of the first and second subframes when using a two subframe temporal primary in the three subframe modulation scheme, and apply error diffusion in at least a first subframe for a four subframe temporal primary, applying error diffusion in one of first and second subframes when using a three subframe temporal primary in the four subframe modulation scheme, and applying error diffusion in one or first, second or third subframes when using a two subframe temporal primary in the four subframe modulation scheme.

Figure 15:
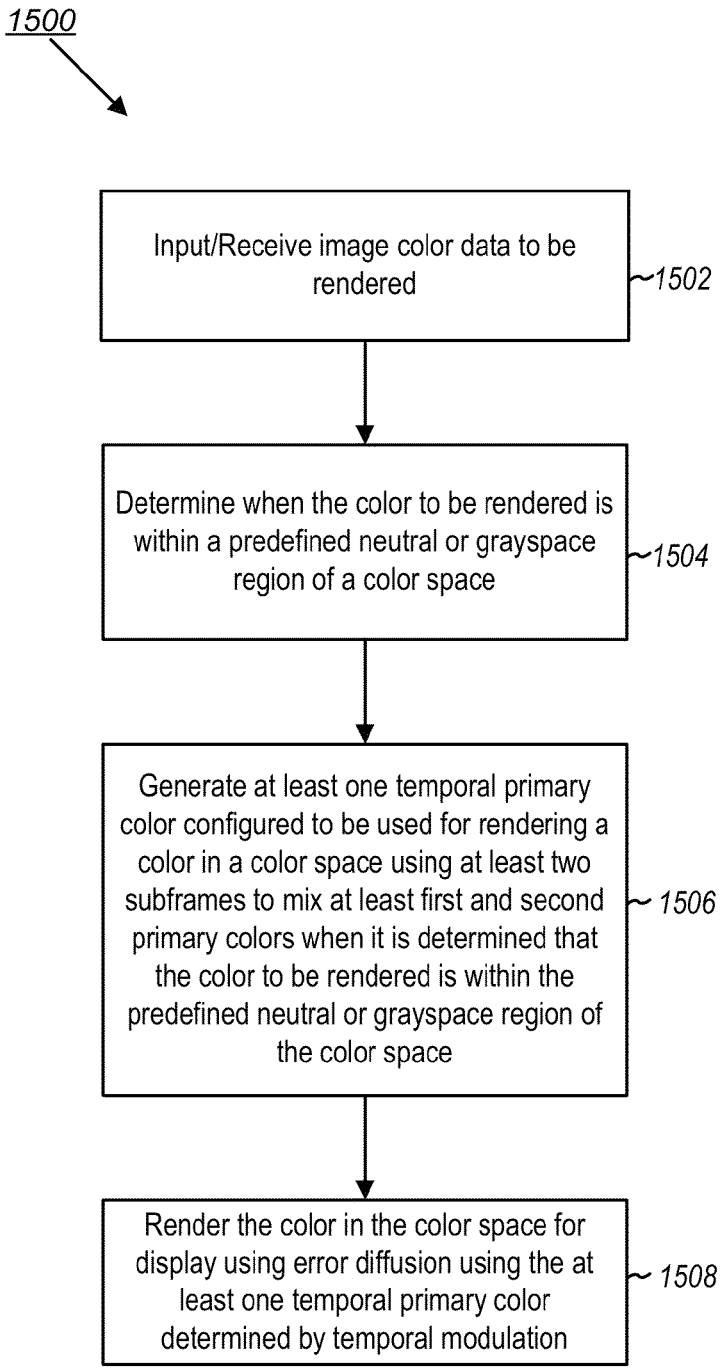
FIG. 15 illustrates a flow diagram of an exemplary method for rendering colors in a display device.

FIG. 15 illustrates a flow diagram of an exemplary method 1500 for rendering colors in a display device. Method 1500 includes first receiving image color data to be rendered as illustrated at block 1502. The image color data may be standard RGB (sRGB), as one example, but could be other types of image color data as well. In accordance with the presently disclosed concepts, method 1500 further includes the process in block 1504 of determining when the color to be rendered is within a predefined neutral or grayspace region of a color space, such as the region in a color space between the white W and black K primaries along or around an line or axis there between. Method 1500 then further includes process 1506 of generating at least one temporal primary color (i.e., virtual primary) that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral or grayspace region of the color space. Although the first and second primary colors may normally be white W and black K as discussed before, it is noted that they are not necessarily limited to such. For example, the first and second primaries may be near-neutral colors close to white and black, respectively, with little chroma wherein the line or axis there between is in or around the neutral, near-neutral, or grayscale region of a color space.

Method 1500 also may of course include the process of then rendering the color in the color space for display using error diffusion using the at least one temporal primary color determined by temporal modulation as illustrated by block 1508. Additionally, during the process of determining or generating the temporal or virtual primary, a further determination may be made to determine whether to utilize a virtual primary using a two, three, or four subframe modulation scheme (e.g., virtual primaries from one of FIG. 8, 10, or 11). This determination may be made based on which virtual primary lies closest to the color X to be rendered. Furthermore, the disclosed methodology may further include a determination of when to apply error diffusion based on the selected modulation scheme (i.e., at which subframe is error diffusion applicable). For example, as described before, for a two subframe modulation with primary (W+K)/2, error diffusion is applied at the first subframe as the modulation will require both subframes. As another example, in the four subframe modulation scheme (See FIG. 11), error diffusion would be applied in the first subframe for a four subframe virtual primary (e.g., 1104 in FIG. 11), in the first or second subframe for a 3 subframe virtual primary (e.g., 1004 in FIG. 10), or the first, second, or third subframes for a 2 subframe virtual primary.

Figure 16:
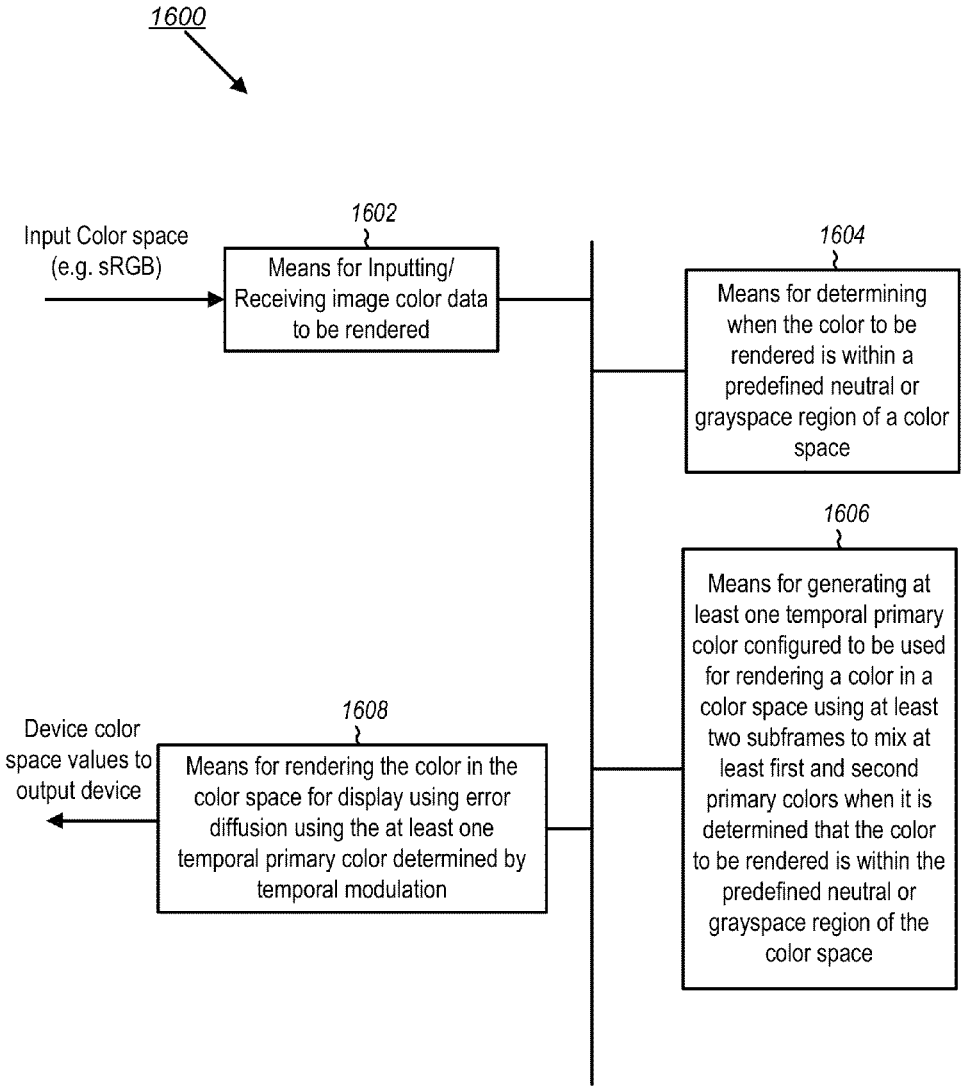
FIG. 16 illustrates another exemplary apparatus that may be used to render colors for display, such as display with an AIMOD display.

FIG. 16 illustrates another exemplary apparatus 1600 that may be used to render colors for display, such as display using an AIMOD display. As illustrated, apparatus 1600 includes means 1602 for inputting or receiving image color data to be rendered, such as sRGB data as illustrated. Further, a means 1604 communicatively coupled with means 1602 is provided for determining when the color to be rendered is within a predefined neutral or grayspace region of a color space.

Apparatus 1600 further includes means 1606 for generating at least one temporal primary color configured to be used for rendering a color in a color space using at least two subframes to mix at least first and second primary colors when it is determined that the color to be rendered is within the predefined neutral or grayspace region of the color space. Finally, the apparatus of FIG. 16 includes means 1608 for rendering the color in the color space for display using error diffusion using the at least one temporal primary color determined by temporal modulation. The output of means 1608 include device color space values to an output device, such as an AIMOD display. It is noted that the various means illustrated in FIG. 16 may be implemented by one or more of units 1402, 1404, 1406, and/or 1408 illustrated in the apparatus of FIG. 14, or equivalent processors, logic circuits, FPGAs, or combinations thereof.

In summary, with the inventive virtual primaries generated along the neutral or near-neutral line or axis, the probability of finding two neutral primaries (W and K) is much higher in vector error diffusion. Since using W and K to produce gray is more robust than using two complementary colors, an AIMOD display will produce more robust neutral and near neutral colors. Moreover, the present methods and apparatus also provide the benefits of less observer metamerism for neutral and near-neutral colors, higher tolerance for the color inaccuracy of color primaries, and less color shift from different viewing angles.

It is noted that the word "exemplary" is used herein to mean "serving as an example, instance, or illustration." Any embodiment or example described herein as "exemplary" is not necessarily to be construed as preferred or advantageous over other embodiments or examples.

It is understood that the specific order or hierarchy of steps in the processes disclosed is merely an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Those of skill in the art will understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill will further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium may be coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may be discrete components. The storage medium may be considered part of a "computer program product," wherein the medium include computer codes or instructions stored therein that may cause a processor or computer to effect the various functions and methodologies described herein.

The above description of the disclosed embodiments is provided to enable any person skilled in the art to make or use the presently disclosed methods and apparatus. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for rendering colors in a display device comprising:

receiving a color to be rendered;

determining when the color to be rendered is within a predefined neutral region of a color space;

generating at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space; and providing color rendering information to a display of the display device, the color rendering information including information for rendering the color in the color space for the display using the at least one temporal primary color determined by the temporal modulation.

2. The method as defined in claim 1, wherein the at least one temporal primary color is generated to be located on an axis between the first and second primary colors.

3. The method as defined in claim 1, wherein the first primary color is white and the second primary color is black.

4. The method as defined in claim 3, wherein the at least one temporal primary color is generated to be located between the white and black primary colors, and is in an area of the color space having at least one of neutral and near-neutral color characteristics.

5. The method as defined in claim 1, wherein generation of the at least one temporal primary color by temporal modulation includes using one of a two, a three, or a four subframe modulation scheme, wherein each modulation scheme includes respectively defined temporal primary colors.

6. The method as defined in claim 5, further comprising generating the at least one temporal primary color with white (W) and black (K) primary colors such that the at least one temporal primary color comprises:

(a) (W+K)/2 when generated with a two subframe modulation scheme;

(b) at least one of (2W+K)/3 and (W+2K)/3 when generated with a three subframe modulation scheme; and (c) at least one of (3W+K)/4 and (W+3K)/4 when generated with a four subframe modulation scheme.

7. The method as defined in claim 5, further comprising:

determining which one of the two, three, and four subframe modulation schemes to choose from based on which scheme has a respective virtual primary that lies closest to the color X to be rendered in the color space.

8. The method as defined in claim 1, further comprising:

rendering the color in the color space for the display using error diffusion with the at least one temporal primary color.

9. The method as defined in claim 8, wherein timing of when to apply error diffusion is based on a selected subframe modulation scheme and wherein the selected subframe modulation scheme is one of a two subframe modulation scheme, a three subframe modulation scheme or a four subframe modulation scheme.

10. The method as defined in claim 9, wherein:

the two subframe modulation scheme involves applying error diffusion for a two subframe primary at a first subframe;

the three subframe modulation scheme involves applying error diffusion in at least a first subframe for a three subframe temporal primary, and applying error diffusion in one of the first and second subframes when using a two subframe temporal primary; and the four subframe modulation scheme involves applying error diffusion in at least a first subframe for a four subframe temporal primary, applying error diffusion in one of first and second subframes when using a three subframe temporal primary, and applying error diffusion in one or first, second or third subframes when using a two subframe temporal primary.

11. An apparatus for rendering colors in a display device comprising:

means for receiving a color to be rendered;

means for determining when the color to be rendered is within a predefined neutral region of a color space;

means for generating at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space; and means for rendering the color in the color space for a display of the display device, using the at least one temporal primary color determined by temporal modulation.

12. The apparatus as defined in claim 11, wherein the at least one temporal primary color is generated to be located on an axis between the first and second primary colors.

13. The apparatus as defined in claim 11, wherein the first primary color is white and the second primary color is black.

14. The apparatus as defined in claim 13, wherein the at least one temporal primary color is generated to be located between the white and black primary colors, and is in an area of the color space having at least one of neutral and near-neutral color characteristics.

15. The apparatus as defined in claim 11, wherein the means for generating the at least one temporal primary color by temporal modulation includes means for using one of a two, a three, or a four subframe modulation scheme, wherein each modulation scheme includes respectively defined temporal primary colors.

16. The apparatus as defined in claim 15, further comprising means for generating the at least one temporal primary color with white (W) and black (K) primary colors such that the at least one temporal primary color comprises:

(a) (W+K)/2 when generated with a two subframe modulation scheme;

(b) at least one of (2W+K)/3 and (W+2K)/3 when generated with a three subframe modulation scheme; and (c) at least one of (3W+K)/4 and (W+3K)/4 when generated with a four subframe modulation scheme.

17. The apparatus as defined in claim 15, further comprising:

means for determining which one of the two, three, and four subframe modulation schemes to choose from based on which scheme has a respective virtual primary that lies closest to the color X to be rendered in the color space.

18. The apparatus as defined in claim 11, further comprising:

means for rendering the color in the color space for the display using error diffusion with the at least one temporal primary color.

19. The apparatus as defined in claim 18, wherein timing of when to apply error diffusion is based on a selected subframe modulation scheme and wherein the selected subframe modulation scheme is one of a two subframe modulation scheme, a three subframe modulation scheme or a four subframe modulation scheme.

20. The apparatus as defined in claim 19, further comprising:

means for applying error diffusion for a two subframe primary at a first subframe if the selected subframe modulation scheme is a two subframe modulation scheme;

means for applying error diffusion in at least a first subframe for a three subframe temporal primary, and means for applying error diffusion in one of the first and second subframes when using a two subframe temporal primary if the selected subframe modulation scheme is a three subframe modulation scheme; and means for applying error diffusion in at least a first subframe for a four subframe temporal primary, means for applying error diffusion in one of first and second subframes when using a three subframe temporal primary, and means for applying error diffusion in one or first, second or third subframes when using a two subframe temporal primary if the selected subframe modulation scheme is a four subframe modulation scheme.

21. An apparatus for rendering colors in a display device comprising:

a receiving unit capable of receiving a color to be rendered;

a determining unit capable of determining when the color to be rendered is within a predefined neutral region of a color space; and a temporal primary generation unit capable of generating at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space, wherein the apparatus is capable of providing color rendering information to a display of the display device, the color rendering information including information for rendering the color in the color space for the display using the at least one temporal primary color determined by the temporal modulation.

22. The apparatus as defined in claim 21, wherein the at least one temporal primary color is generated to be located on an axis between the first and second primary colors.

23. The apparatus as defined in claim 21, wherein the first primary color is white and the second primary color is black.

24. The apparatus as defined in claim 23, wherein the at least one temporal primary color is generated to be located between the white and black primary colors, and is in an area of the color space having at least one of neutral and near-neutral color characteristics.

25. The apparatus as defined in claim 21, wherein the generation unit is further capable of use one of a two, a three, or a four subframe modulation scheme, wherein each modulation scheme includes respectively defined temporal primary colors.

26. The apparatus as defined in claim 25, further comprising generating the at least one temporal primary color with white (W) and black (K) primary colors such that the at least one temporal primary color comprises:

(a) (W+K)/2 when generated with a two subframe modulation scheme;

(b) at least one of (2W+K)/3 and (W+2K)/3 when generated with a three subframe modulation scheme; and (c) at least one of (3W+K)/4 and (W+3K)/4 when generated with a four subframe modulation scheme.

27. The apparatus as defined in claim 25, the determining unit further capable of determine which one of the two, three, and four subframe modulation schemes to choose from based on which scheme has a respective virtual primary that lies closest to the color X to be rendered in the color space.

28. The apparatus as defined in claim 21, further comprising:

a rendering unit capable of render the color in the color space for the display using error diffusion with the at least one temporal primary color.

29. The apparatus as defined in claim 28, wherein timing of when to apply error diffusion is based on a selected subframe modulation scheme and wherein the selected subframe modulation scheme is one of a two subframe modulation scheme, a three subframe modulation scheme or a four subframe modulation scheme.

30. The apparatus as defined in claim 29, the rendering unit further configured to:

apply error diffusion for a two subframe primary at a first subframe if the selected subframe modulation scheme is a two subframe modulation scheme;

apply error diffusion in at least a first subframe for a three subframe temporal primary, and applying error diffusion in one of the first and second subframes when using a two subframe temporal primary if the selected subframe modulation scheme is a three subframe modulation scheme; and apply error diffusion in at least a first subframe for a four subframe temporal primary, applying error diffusion in one of first and second subframes when using a three subframe temporal primary, and applying error diffusion in one or first, second or third subframes when using a two subframe temporal primary if the selected subframe modulation scheme is a four subframe modulation scheme.

31. A computer program product comprising:

a computer-readable medium comprising:

code for causing a computer to receive a color to be rendered;

code for causing a computer to determine when the color to be rendered is within a predefined neutral region of a color space; and code for causing a computer to generate at least one temporal primary color that is configured to be used for rendering a color in a color space, wherein the at least one temporal primary color is generated by temporal modulation using at least two subframes to mix at least first and second primary colors, wherein the at least one temporal primary color is operable for rendering the color to be rendered when it is determined that the color to be rendered is within the predefined neutral region of the color space.

32. The computer program product as defined in claim 31, wherein the at least one temporal primary color is generated to be located on an axis between the first and second primary colors.

33. The computer program product as defined in claim 31, wherein the first primary color is white and the second primary color is black.

34. The computer program product as defined in claim 33, wherein the at least one temporal primary color is generated to be located between the white and black primary colors, and is in an area of the color space having at least one of neutral and near-neutral color characteristics.

35. The computer program product as defined in claim 31, wherein the code for causing a computer to generate at least one temporal primary color by temporal modulation includes code for causing the computer to select use of one of a two, a three, or a four subframe modulation scheme, wherein each modulation scheme includes respectively defined temporal primary colors.

36. The computer program product as defined in claim 35, the computer-readable medium further comprising:

code for causing a computer to generate the at least one temporal primary color with white (W) and black (K) primary colors such that the at least one temporal primary color comprises:

(a) (W+K)/2 when generated with a two subframe modulation scheme;

(b) at least one of (2W+K)/3 and (W+2K)/3 when generated with a three subframe modulation scheme; and (c) at least one of (3W+K)/4 and (W+3K)/4 when generated with a four subframe modulation scheme.

37. The computer program product as defined in claim 35, the computer-readable medium further comprising:

code for causing a computer to determine which one of the two, three, and four subframe modulation schemes to choose from based on which scheme has a respective virtual primary that lies closest to the color X to be rendered in the color space.

38. The computer program product as defined in claim 31, the computer-readable medium further comprising:

code for causing a computer to render the color in the color space for display using error diffusion with the at least one temporal primary color.

39. The computer program product as defined in claim 38, wherein timing of when to apply error diffusion is based on a selected subframe modulation scheme of one of the two, three, and four subframe modulation schemes.

40. The computer program product as defined in claim 39, the computer-readable medium further comprising:

code for causing a computer to apply error diffusion for a two subframe primary at a first subframe in a two subframe modulation scheme;

code for causing a computer to apply error diffusion in at least a first subframe for a three subframe temporal primary in a three subframe modulation scheme, and means for applying error diffusion in one of the first and second subframes when using a two subframe temporal primary in the three subframe modulation scheme; and code for causing a computer to apply error diffusion in at least a first subframe for a four subframe temporal primary, means for applying error diffusion in one of first and second subframes when using a three subframe temporal primary in the four subframe modulation scheme, and means for applying error diffusion in one or first, second or third subframes when using a two subframe temporal primary in the four subframe modulation scheme.

* * * * *